United States Patent [19]

Ishida et al.

[11] Patent Number: 4,587,211

[45] Date of Patent: May 6, 1986

[54] PHOTOTHERMOGRAPHIC STABILIZERS FOR SYRINGALDAZINE LEUCO DYES

[75] Inventors: Takuzo Ishida, Woodbury; David C. Weigel, White Bear Lake, both of Minn.

[73] Assignee: Minnesota Mining and Manufacturing Company, St. Paul, Minn.

[21] Appl. No.: 697,279

[22] Filed: Feb. 1, 1985

[51] Int. Cl.[4] ..... G03C 1/02

[52] U.S. Cl. ..... 430/619; 430/617; 430/620; 430/559; 430/351

[58] Field of Search ..... 430/617, 619, 620, 351, 430/559

[56] References Cited

U.S. PATENT DOCUMENTS 3,297,710 1/1967 Silversmith ..... 260/309

3,985,565 10/1976 Gabrielson ..... 96/114.1

*Primary Examiner*—Won H. Louie

*Attorney, Agent, or Firm*—Donald M. Sell; James A. Smith; Mark A. Litman

[57] ABSTRACT

Certain effective leuco dyes for silver halide/silver salt/reducing agent photothermographic color imaging materials tend to bleach in the final image. The presently disclosed system of a syringaldazine and a stabilizing binder resin is more stable.

13 Claims, No Drawings

PHOTOTHERMOGRAPHIC STABILIZERS FOR SYRINGALDAZINE LEUCO DYES

BACKGROUND OF THE INVENTION

1. Field of the Invention

The present invention relates to dry silver photothermographic imaging materials and to stabilizers for syringaldazine leuco dyes used in color photothermographic imaging systems.

2. Prior Art

Photosensitive, heat-developable, dry silver sheet materials, as described for example in U.S. Pat. Nos. 3,457,075 and 3,839,049, contain a photosensitive silver halide catalyst-forming means in catalytic proximity with a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures. To improve the image density and color it has been found desirable to include toners in the sheet construction.

Color photothermographic imaging systems have been described in patent literature. U.S. Pat. No. 3,531,286 describes a system using paraphenylenediamine and photographic color couplers. U.S. Pat. No. 3,985,565 discloses the use of phenolic leuco dye reducing agents to reduce the silver and provide a color image. U.S. Pat. No. 4,460,861 discloses a multilayer color photothermographic system using a variety of leuco dyes separated by barrier layers.

BRIEF DESCRIPTION OF THE INVENTION

In accordance with the practice of the present invention, it has now been found possible to provide photosensitive, heat-developable, dry silver imaging sheets which give good, stable color images using leuco dyes which are derivatives of syringaldehyde. The stabilizers are resins which comprise poly(vinyl chloride) and/or poly(vinylidene chloride).

DETAILED DESCRIPTION OF THE INVENTION

In order to provide a full spectrum of color in the final image of a color photothermographic element, a wide variety of leuco dyes providing different final colors should be available. Many leuco dyes tend to be highly sensitive to the active environment of a photothermographic emulsion. This sensitivity can occur either to the leuco dye or to the dye generated by oxidation of the leuco dye.

Certain leuco dye derivatives of syringaldazine provide useful dye colors upon oxidation, but the dyes are rapidly bleached in the photothermographic system. The dyes of particular importance are 4-hydroxy-3,5-dialkoxybenzaldehyde azines. The preferred dyes are where the alkoxy groups are 3,5-diethoxy or 3,5-dimethoxy. These leuco dyes produce useful colors upon oxidation, but are readily bleached by the photothermographic emulsion. The synthesis of syringaldazines is taught in "Use of Syringaldazine in a Photometric Method for Estimating 'Free' Chlorine in Water", R. Bauer et al., Analytical Chemistry, Vol. 43, No. 3, March 1971, and is commercially available.

It has been found that the addition of a class of resins to the emulsion helps to stabilize the color image produced by the syringaldazine leuco dyes. The addition of a stabilizing amount of a polymer or copolymer of a resin comprising poly(vinyl chloride) and/or poly(viny(vinylidene chloride) has been found to be useful in the present invention. By 'copolymer' it is meant that the polymer contains at least 25 molar percent of poly(vinlyl chloride) and/or poly(vinylidene chloride) in the resin, the term being inclusive of terpolymers, block copolymers, etc. Specific resins which have been tried and found to be useful are homopolymers of poly(vinyl chloride) and poly(vinylidene chloride), copolymers of poly(vinyl chloride) and poly(vinylidene chloride), and copolymers of poly(vinyl chloride) with vinyl acetate and vinyl alcohol.

The amount of stabilizing resin material may be varied from one construction and formulation to the next. It is therefore desirable to incorporate an effective amount of resin to produce the desired image stabilizing benefits. With the weak reducing agents or developers, such as the hindered phenols, a lesser amount of resin can be employed than with the stronger reducing agents, such as methyl gallate, hydroquinone and methoxy hydroxy naphthalene. Resin concentration will particularly vary with the proportion of syringaldazine leuco dyes as well as with the thickness of the coating and developing conditions, e.g., heat development time and temperature. Thus, for example, one construction may require a temperature of 260° F. (126° C.) with a dwell time of 3 seconds, while another may required 300° F. (147° C.) for 5 seconds, and still another may need 230° F. (110° C.) for 35 seconds, and the amount of stabilizing resin and type of reducing agent may be varied accordingly. In most constructions the concentrations of the active resin ingredient (the poly(vinylchloride) or poly(vinylidene chloride)) will fall in the range of 0.25 to 50 times the weight of the leuco dye, preferably in the range of 0.40 to 40 times the weight of the leuco dye. The leuco dye is present in a transmission optical density of 0.5 upon oxidation of 100% of the dye. The leuco dye, expressed in other terms, may be present as from 0.5 to 20% by dry weight of the layer it is coated out in, preferably from 0.75 to 15% by dry weight of that layer.

Photothermographic dry silver emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and some of the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toner materials may also be present, for example, in amounts of from 0.2 to 10 percent by weight of all silver-bearing components. Toners are well known materials in the photothermographic art as shown by U.S. Pat. Nos. 3,080,254; 3,847,612 and 4,123,282.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight. The binder for the layer containing the syringaldazine leuco dye must of course comprise an effective amount of the stabilizing binder of the present invention.

For use on paper or other non-transparent backings it is found convenient to use silver half-soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver, may be used. Other components, such as coloring, opacifiers, extenders, spectral sensitizing dyes, etc. may be incorporated as required for various specific purposes. Antifoggants, such as mercuric salts and tetrachlorophthalic anhydride, may also be included in the formulation.

EXAMPLES 1–5

A master batch coating composition consisting of 127 grams half soap homogenate, 54 grams toluene, 68.5 grams poly(vinyl butyral), 3 ml of HgO Acetate (0.4 g Hg/10 ml methanol), 3 ml of $HgBr_2$ (3.60 g $HgBr_2$/100 ml methanol), and 6 ml of $CaBr^2$ (2.36 g/100 ml methanol) was prepared. A second master batch coating composition of 0.2 g of the dimethyl syringaldazine, 0.2 g phthalazinone, and 2 ml of RP421 (0.2 g/100 ml methanol) and various weights of a 20% by weight solution of a vinyl chloride/vinyl acetate/vinyl alcohol copolymer (91/3/6) in methylethylketone was also prepared. The coating compositions were mixed applied at a topcoating weight of about 1.95 g/ft$^2$ and dried for 2½ minutes at 89° C. The resulting article was exposed (1,200 foot-candle-seconds of incident tungsten light at 28° C. and 60% relative humidity) through a 0–4 continuous wedge. The initial $D_{min}$ and the initial $D_{max}$ were recorded.

After two hours of aging under 5,000 metercandle of ultraviolet radiation, $D_{min}$ and $D_{max}$ were recorded.

The results with the noted various amounts of copolymer resin are shown in Table I.

TABLE 1

| Ex. | Copolymer (grams) | Initial $D_{min}$ | Final $D_{min}$ | Initial $D_{max}$ | Final $D_{min}$ |
|---|---|---|---|---|---|
| 1 | 0 | 0.18 | 0.16 | 1.72 | 0.31 |
| 2 | 0.5 | 0.15 | 0.20 | 1.46 | 0.58 |
| 3 | 1.25 | 0.19 | 0.19 | 1.14 | 0.62 |
| 4 | 2.5 | 0.15 | 0.21 | 1.19 | 0.78 |
| 5 | 5 | 0.13 | 0.16 | 0.90 | 0.64 |

The data show that even where the initial $D_{max}$ was only 0.90 with the use of stabilizing resin, as compared to an initial $D_{max}$ of 1.72 without stabilizing resin, the final $D_{max}$ was more than twice as great with the resin as it was without the resin. Stated another way, the dye image lost 80% of its density without the resin present and lost only 60%, 45%, 35%, and 29% of its density where the resin was used. In all cases, the final image density with the resin was greater than the final image density without the resin.

EXAMPLE 6

This example shows the utility of poly(vinylidene chloride) in the practice of the present invention. The formulations used in this example were as follows:

| | | |
|---|---|---|
| 1st Trip: | Half soap homogenate of Example 1 | 127 g |
| | Poly(vinylbutyral) | 0.1 g |
| | Mercuric Bromide (2.36 g/100 MeOH) | 12 ml |
| | Poly(vinyl butyral) | 28 g |
| 2nd Trip: | Syringaldazine (3,5-dimethyl) | 0.2 g |
| | Phthalazinone | 0.3 g |
| | Methanol | 5 ml |
| | Acetone | 12 ml |
| | Poly(vinylidene chloride) (10% in MEK) | 30 g |

These solutions were coated 3 mils wet and dried at 180° F. for 5 minutes. Typical U.V. exposure results are:

| | |
|---|---|
| Initial $D_{max}$: 2.45 | 2 Hours $D_{max}$: 1.51 |
| $D_{min}$: 0.12 | Light Aging $D_{min}$: 0.16 |

A sample with another resin poly(vinyl butyral) substituted for the poly(vinylidene chloride) bleached completely. Samples with polystyrene, polystyrene/acrylonitrile copolymer, and alcohol soluble butyrates also bleached completely under identical circumstances.

What is claimed is:

1. In a color forming photosensitive, heat-developable, dry silver sheet material comprising a binder, a photosensitive silver halide catalyst-forming means and, as heat sensitive image forming means, a light insensitive organic silver compound and a color forming leuco dye reducing agent therefor, the improvement characterized by said leuco dye being a syringaldazine and said binder comprising a color image stabilizing amount of a resin selected from the group consisting of polymers and copolymer of poly(vinyl chloride) and poly(vinylidene chloride.)

2. The dry silver sheet material of claim 1 wherein said binder comprises a poly(vinylidene chloride) resin.

3. The dry silver sheet material of claim 1 wherein said binder comprises poly(vinyl chloride).

4. The dry silver sheet material of claim 1 wherein said leuco dye is a 4-hydroxy-3,5-dialkoxy benzaldehyde azine.

5. The dry silver sheet material of claim 1 wherein said leuco dye is selected from the group of 4-hydroxy-3,5-diethoxybenzaldehyde azine and 4-hydroxy-3,5-dimethoxybenzaldehyde azine.

6. The dry silver sheet material of claim 5 wherein said binder is a copolymer of poly(vinyl chloride).

7. The dry silver sheet material of claim 5 wherein said binder is a copolymer of poly(vinylidene chloride).

8. The dry silver sheet material of claim 7 wherein said leuco dye is 4-hydroxy-3,5-dimethoxybenzaldehyde azine.

9. The dry silver sheet material of claim 6 wherein said leuco dye is 4-hydroxy-3,5-dimethoxybenzaldehyde azine.

10. The dry silver sheet material of claim 7 wherein said poly(vinylidene chloride) copolymer is present at the weight ratio of vinylidene chloride units to leuco dye of from 0.25 to 50.

11. The dry silver sheet of claim 6 wherein said poly(vinyl chloride) copolymer is present at the weight ratio of vinyl chloride units to leuco dye of from 0.25 to 50.

12. The dry silver sheet of claim 8 which further comprises a toner mixture of from 0.2 to 10 percent by weight of all silver-bearing components.

13. The dry silver sheet of claim 9 which further comprises a toner mixture of from 0.2 to 10 percent by weight of all silver-bearing components.

* * * * *